US005791470A

United States Patent [19]

Usui

[11] Patent Number: 5,791,470

[45] Date of Patent: Aug. 11, 1998

[54] PAINT BRUSH PACKAGE AND DISPLAY ARTICLE

[76] Inventor: Sam S. Usui, 90 Duncan Dr. P.O. Box 11240, Greenwich, Conn. 06831

[21] Appl. No.: 762,325

[22] Filed: Dec. 9, 1996

[51] Int. Cl.[6] ..... B65D 83/10

[52] U.S. Cl. ..... 206/362.4; 206/464; 206/476; 206/482; 206/763

[58] Field of Search ..... 206/361, 362.4, 206/461, 464, 476, 486, 756, 762, 763, 477, 482

[56] References Cited

U.S. PATENT DOCUMENTS

| | | | |
|---|---|---|---|
| 2,944,665 | 7/1960 | Obeck | 206/476 |
| 3,055,492 | 9/1962 | Franklin et al. | 206/361 |
| 3,130,833 | 4/1964 | Glasser et al. | 206/482 |
| 3,847,282 | 11/1974 | Collura et al. | 206/476 |
| 3,927,762 | 12/1975 | Zdarsky et al. | 206/482 |
| 4,171,050 | 10/1979 | Murray et al. | 206/476 |
| 4,976,354 | 12/1990 | Levy | 206/476 |
| 5,375,717 | 12/1994 | Roshdy | 206/476 |
| 5,477,964 | 12/1995 | Hart | 206/482 |
| 5,593,025 | 1/1997 | Feibelman | 206/756 |

*Primary Examiner*—David T. Fidei
*Attorney, Agent, or Firm*—Alfred E. Miller

[57] ABSTRACT

A package and display unit for an elongated article, such as an artist's paint brush, in the form of an elongated cardboard blank having openings, score lines, a puncture hole and flaps whereby the blank can be folded along the score lines and a flap inserted through an opening to form a package in which the bottom of the paint brush handle can pass through the puncture hole and the upper part of the handle is held to the package by securing means so that both the brush portion and the handle portion can be felt by a prospective user.

8 Claims, 2 Drawing Sheets

PAINT BRUSH PACKAGE AND DISPLAY ARTICLE

The present invention relates to a packaging and display device for thin, elongated products, such as artist's paint brushes which are normally merchandised in point-of-purchase displays.

BACKGROUND OF THE INVENTION

It is well known to display a variety of products which are intended for sale in packaging on walls and display boards, such as blister packaging, shrink wrapping and cartons. Most of the packaging have some form of transparent covering so that the products can be readily observed.

In the case of packaging and displaying an artist's brush it is known that artists not only desire to see the brush and handle, but require the ability to feel the brush bristles in order to select the proper tactile quality of the brush bristles for the intended use.

A display package for a paint brush is known from U.S. Pat. No. 4,053,050 to Forbes, Jr. et al. which is formed from a flat blank of paperboard which is folded and glued to form a package that exposes the bristles of the paint brush. However, the handle is located in an opening that is covered by a transparent window and the handle is not attached to the package and therefore the button of the handle is not secure in the package and only a narrow cardboard panel secures the brush ferrule to the package whereby the brush could be dislodged during shipping. It is also necessary to glue the paperboard blank after folding to form a package.

SUMMARY OF THE INVENTION

It is a feature of the present invention to provide a paint brush package and display article in which both the brush bristles and paint brush handle are exposed for observation and touch and feel.

It is another feature of the present invention to provide display package for an artist's paint brush which is fabricated of a unitary flat, rectangular shaped blank of cardboard or paperboard material that is punctured, scored, and having a latching flap for assembling the display package without the use of glue or any other type adhesive.

It is another object of the present invention to provide an inexpensive package and display article which reliably secures an artist's paint brush for both shipping and display.

A further feature of the present invention is to provide a display package which itself is the complete wrapper for the displayed item and the brush article therein is affixed to the package at two spaced locations.

BRIEF DESCRIPTION OF THE DRAWINGS

In order that the invention may be more clearly understood, it will now be disclosed in greater detail with reference to the accompanying drawings, wherein.

DETAILED DESCRIPTION OF THE INVENTION

Figure 1:
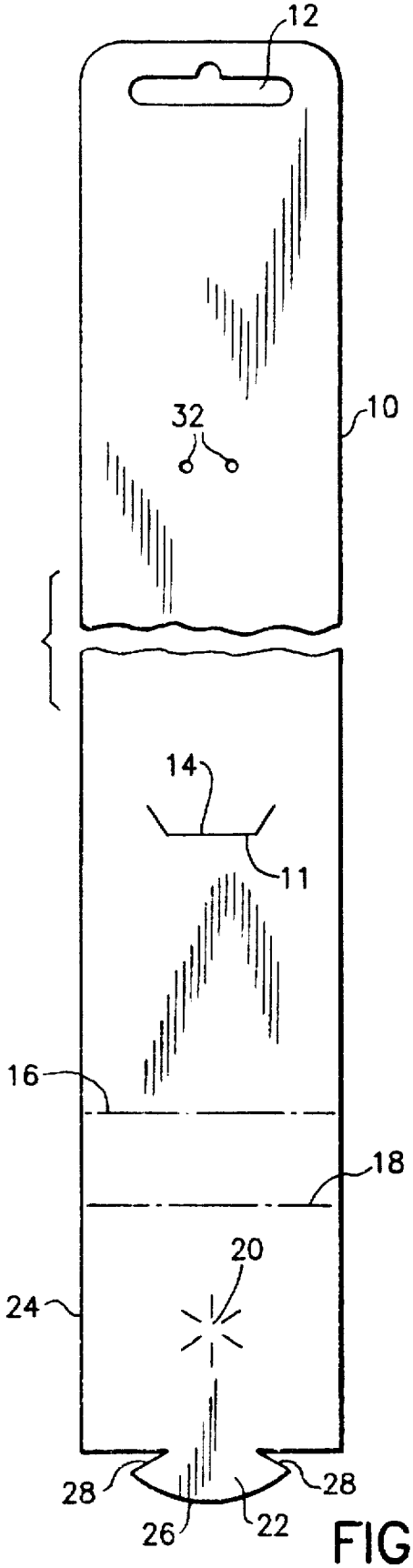
FIG. 1 is a plan view of a unitary flat blank of paperboard showing the fold lines, cut outs, punctures and flaps of the paint brush package and display article in accordance with the teachings of the present invention.

A display package for a thin, elongated article, such as an artists' paint brush, is shown as a unitary, rectangular-shaped paperboard or cardboard blank 10. At the top of the blank is an opening 12 for hanging the assembled blank with an artist's paint brush on a point-of-purchase display board.

The blank 10 is provided with cut-out flap 14 toward the bottom of the blank resulting in a slit opening, as well as horizontally placed score lines 16 and 18 located below the flap.

A hole 20 is punctured in the blank below the score lines 16 and 18. At the end of the blank remote from the opening 12 is flap 22 integrally connected to the blank 10 having a curved portion 26 connected to the blank by linear parts 28.

Figure 2:
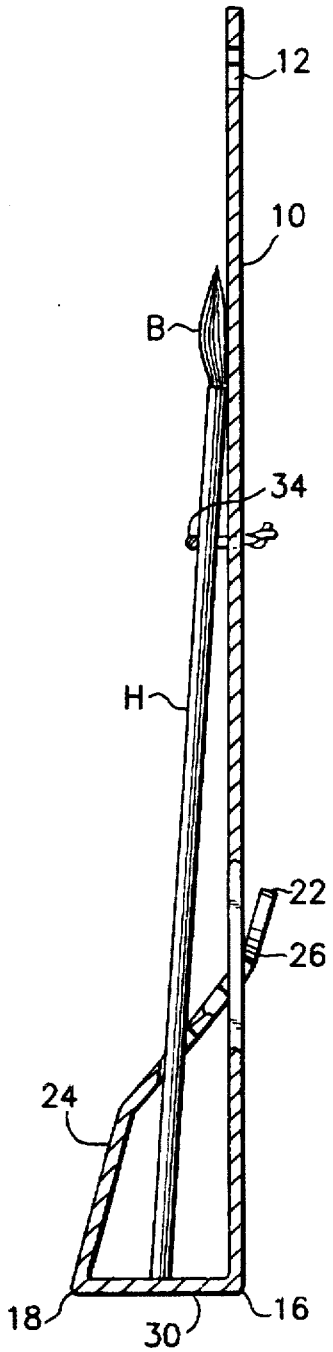
FIG. 2 is a side elevational view of the blank of FIG. 1 being folded and latched housing an artist's paint brush.

The blank 10 can be assembled as a packaging and display article without the use of glue or any other adhesive, as seen in FIG. 2, by folding the bottom portion 24 of the blank along score lines 16 and 18 to form a floor 30 for the package. Thereafter, the curved end portion 26 of the flap 22 is inserted through the slit opening 11 formed by the cut-out flap 14 with the linear parts engaging the rear side of the blank 10 while the depending part 14*a* latches the flap 14 to the blank 10, thus securely maintaining the assembly together.

An artist's paint brush having a handle H and bristles B can be held in the display package by inserting the handle H through the hole 20, as seen in FIG. 2, whereby the bottom of the handle rests on the floor 30. The upper part of the handle H can be secured to the blank by means of a thread or wire 34 passing through the spaced holes 32 in the upper part of the blank.

It should be noted that an inexpensive package and display unit for an article, such as an artist's paint brush, can be made and assembled without the use of glue which permits the prospective user to touch and feel both the paint brush bristles, as well as the handle thereof in contemplation of purchase.

Figure 3:
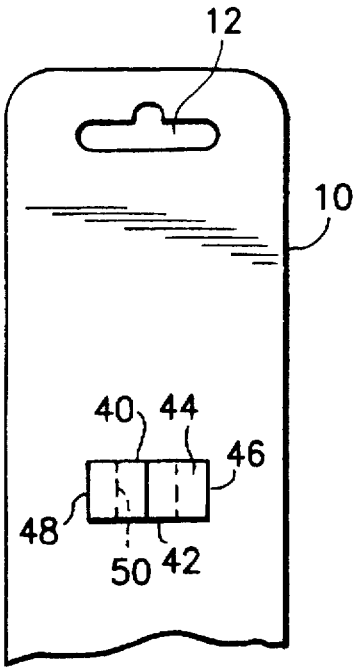
FIG. 3 is a partial plan view of another paperboard blank embodiment of the present invention and FIG. 4 is a side elevational view of the modified paperboard blank shown in FIG. 3.
Figure 4:
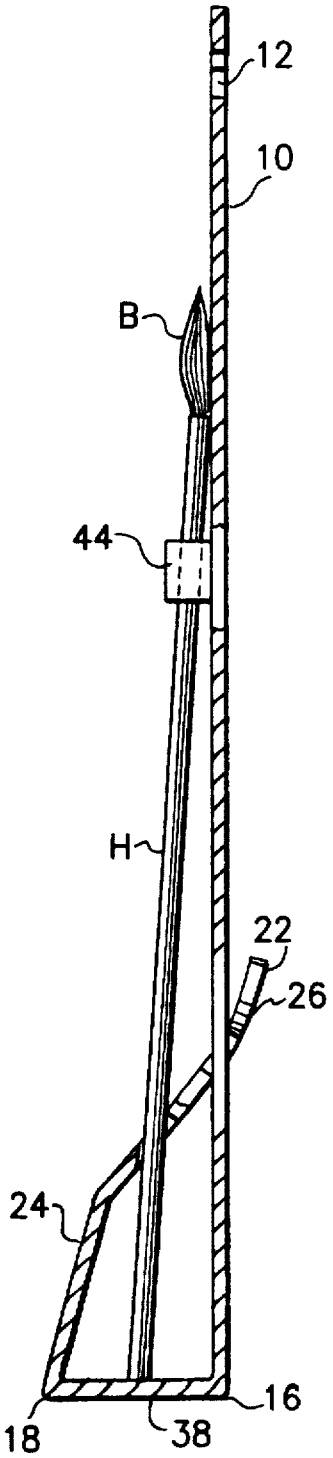

Referring now to FIGS. 3 and 4 in which an alternate embodiment of the present invention is shown the paint brush package and display unit is in the form of a single unitary piece in which there is no other means for holding and displaying the artist's paint brush in the package other than the cut-outs and flaps of the blank 10 itself. Consequently, instead of using a thread or a wire as shown in FIG. 2 of the drawings for securing the handle of the brush to the package, the alternate embodiment discloses a retaining means for the handle of the paint brush adjacent to the bristles which is formed by cut or score lines 40 and 42 forming a panel 44 which can be pulled out from the blank 10 while still being attached to the blank at 46 and 48. The panel 44 is provided with vertical score lines 50 so that the panel can be bent in order to insert the handle H of the paint brush. Consequently, when the paint brush is inserted into the package an upper part of the handle is held by panel 44 is inserted through opening 20 to be held at the bottom by the bottom portion 24 of the blank 10. It should thus be noted that the paint brush is held in the packaging and display package solely by the paperboard blank 10 without the use of additional securing means thereby both simplifying the assembly of the paint brush in the package, and at the same time resulting in a less expensive package, that functions well for the purposes intended.

While the invention has been disclosed and described herein with reference to two embodiments thereof, it will be apparent that variations and modifications may be made therein and, it is therefore intended in the following claims to cover each such variation and modification as falls within the true spirit and scope of the invention.

What is claimed is:

1. A combination package and display article for an artist's paint brush having a handle comprising: an elongated flat cardboard blank having a horizontally located first flap cut out from said blank and provided with a slit opening in the bottom half of said blank, a pair of spaced horizontally disposed score lines positioned below said first flap, a puncture hole in said blank located below said score lines, a second flap integral with the bottom of said blank whereby the bottom of said blank is folded over said fold lines so that a portion of said blank between said score lines is oriented substantially perpendicular to the top half of said blank forming a floor, an end part of said second flap being inserted through the slit opening of said first flap for latching said second flat to said first flap, the bottom of the handle of the paint brush being passed through said puncture hole and resting on said floor, and means to secure the upper part of the handle to the blank.

2. The combination package and display article as claimed in claim 1 wherein said end part of said second flap has a peripheral edge the major part of which is curvalinear.

3. The combination package and display article as claimed in claim 1 further comprising a second opening adjacent to the top of said blank for hanging said article.

4. The combination package and display article as claimed in claim 1 wherein said means to secure the upper part of the handle to the blank is a filament.

5. A combination package and display article for an artist's paint brush having a handle comprising:

an elongated flat cardboard blank having a horizontally located first flap cut out from said blank and provided with a slit opening in the bottom half of said blank, a pair of spaced horizontally disposed score lines positioned below said first flap, a puncture hole in said blank located below said score lines, a second flap integral with the bottom of said blank whereby the bottom of said blank is folded over on said fold lines whereby the portion of said blank between said score lines is oriented substantially perpendicular to the top of said blank and said second flap being inserted through the slit opening of said first flap, the bottom of the handle of the paint brush being passed through said puncture hole, a rectangular panel in the upper half of said blank which is cut from said blank on the long sides thereof and attached to the blank on the short sides, said panel having spaced vertically positioned score lines whereby a portion of said paint brush handle is thereby secured to the upper part of said blank when said panel is bent into engagement with said upper portion of said handle.

6. The combination package and display article as claimed in claim 5 wherein the end part of said second flap is provided with a curved peripheral surface that is inserted through said slit opening in order to latch a bottom portion of said panel in said opening.

7. The combination package and display article as claimed in claim 5 further comprising a second opening adjacent to the top of said blank for hanging said article.

8. The combination package and display article as claimed in claim 5 wherein the means to secure the upper part of said handle to the blank is a thread.

* * * * *